US006150633A

United States Patent [19]

Boertjens

[11] Patent Number: 6,150,633

[45] Date of Patent: Nov. 21, 2000

[54] HEATING ELEMENT FOR A WATER-BED

[75] Inventor: Abram Jan Boertjens, Velp, Netherlands

[73] Assignee: Faber Electronics B.V., Netherlands

[21] Appl. No.: 09/367,134

[22] PCT Filed: Feb. 3, 1998

[86] PCT No.: PCT/NL98/00067

§ 371 Date: Aug. 6, 1999

§ 102(e) Date: Aug. 6, 1999

[87] PCT Pub. No.: WO98/36664

PCT Pub. Date: Aug. 27, 1998

[30] Foreign Application Priority Data

Feb. 20, 1997 [NL] Netherlands ..... 1005321

[51] Int. Cl.[7] ..... H05B 11/00

[52] U.S. Cl. ..... 219/217; 219/532

[58] Field of Search ..... 219/200, 211, 219/212, 217, 527, 528, 532

[56] References Cited

U.S. PATENT DOCUMENTS

| | | | |
|---|---|---|---|
| 3,627,981 | 12/1971 | Kuhn | 219/212 |
| 4,661,689 | 4/1987 | Harrison | 219/528 |
| 4,798,936 | 1/1989 | Johnson, Sr. | 219/217 |

*Primary Examiner*—Tu Ba Hoang
*Attorney, Agent, or Firm*—Thomas, Kayden, Horstemeyer & Risley

[57] ABSTRACT

A heating element for heating a water-bed comprising a metal support plate having a high coefficient of thermal conductivity, a heat source attached to the metal support plate and having an electrically resistive conductor which emits heat when electricity passes through it, and an electrical insulator for insulating the heat source from the metal plate.

4 Claims, 2 Drawing Sheets

FIG. 2
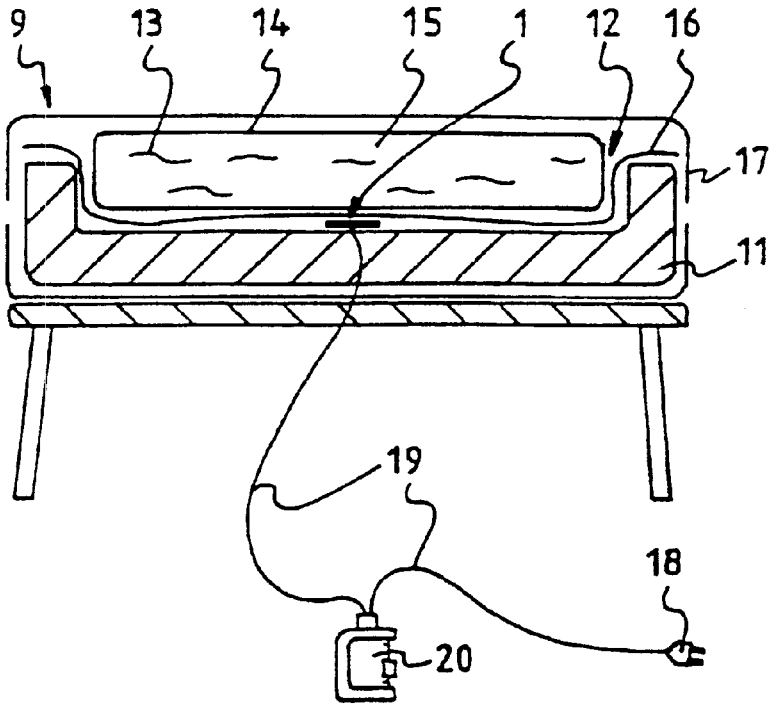
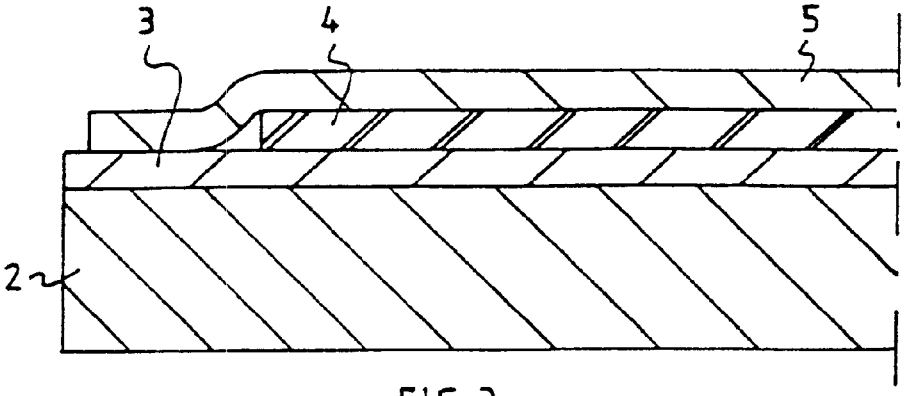
FIG. 3

HEATING ELEMENT FOR A WATER-BED

FIELD OF THE INVENTION

The invention relates to a heating element for heating a water-bed, said heating element comprising a metal support plate with a high coefficient of thermal conductivity, a heat source attached to the metal support plate, said heat source comprising an electrically resistive conductor which emits heat when electricity passes through it, and an electrical insulator for insulating the heat source from the metal plate.

BACKGROUND OF THE INVENTION

It is very important when electrically heating water-beds that the heating elements are very well electrically insulated, so that there is no possibility of current passing through the bed in any way.

European patent application EP-A-0,731,624 discloses a heating element for a water-bed of the sort as described above comprising a flexurally stiff metal support plate, on which a number of small ceramic heating plates are arranged with the aid of a thermally conductive adhesive. Electrical conductors are burnt into these small ceramic plates, which conductors serve as electrical resistance wire for generating heat. That surface of the support plate to which the small ceramic plates are attached is covered with an insulating plate of approximately the same dimensions as the support plate, and both plates are connected to one another in the region of the periphery in such a way that a space remains between the support plate and the insulating plate, in which the small ceramic plates are situated. In this known heating element, the burnt-in electrical conductors are attached by burning in a pasty mixture of small particles of noble metals, such as gold and silver.

This known heating element has various disadvantages. Small ceramic plates can easily break under flexural strain. If a small ceramic plate does break, the electrical conductor on the small plate is interrupted, with the result that the small plate will no longer be able to emit any heat. Thus in order to prevent the fragile small ceramic plates from breaking, the metal support plate to which these ceramic plates are attached has to have a high flexural stiffness, and to achieve this the support plate has to be relatively thick. However, the thicker the support plate, the more slowly the heat is transferred from the small ceramic plates, via the support plate, to the water of the water-bed. Another drawback is that the coefficient of expansion of the metal plate and the small ceramic plates is not identical. As a result, the metal plate will not expand to the same extent as the small ceramic plates when heated. Since it is necessary, in connection with the difference in expansion of the metal plate and the ceramic plates, to prevent excessive stresses on the fragile ceramic plates, the dimensions of the small ceramic plates should not be too large, and therefore, if the heating is still to be controlled within reasonable limits, it is necessary to use more than one small ceramic plate, for example six or more plates. If an plurality of small ceramic plates is used, each small ceramic heating plate has to be connected separately to the power supply. This is carried out here with the aid of a printed circuit board, which regulates the current to the various small ceramic plates. This known heating element thus comprises a very large number of components, so that its production costs are relatively high.

Other known heating systems make use of flexible metal wires, which are electrically insulated from the surroundings with the aid of a plastic material. Since it is always possible for moisture and air to appear inside the wiring, it has been found that this can cause faults, due to the possibility of local overheating.

DETAILED DESCRIPTION OF THE INVENTION

Figure 1:
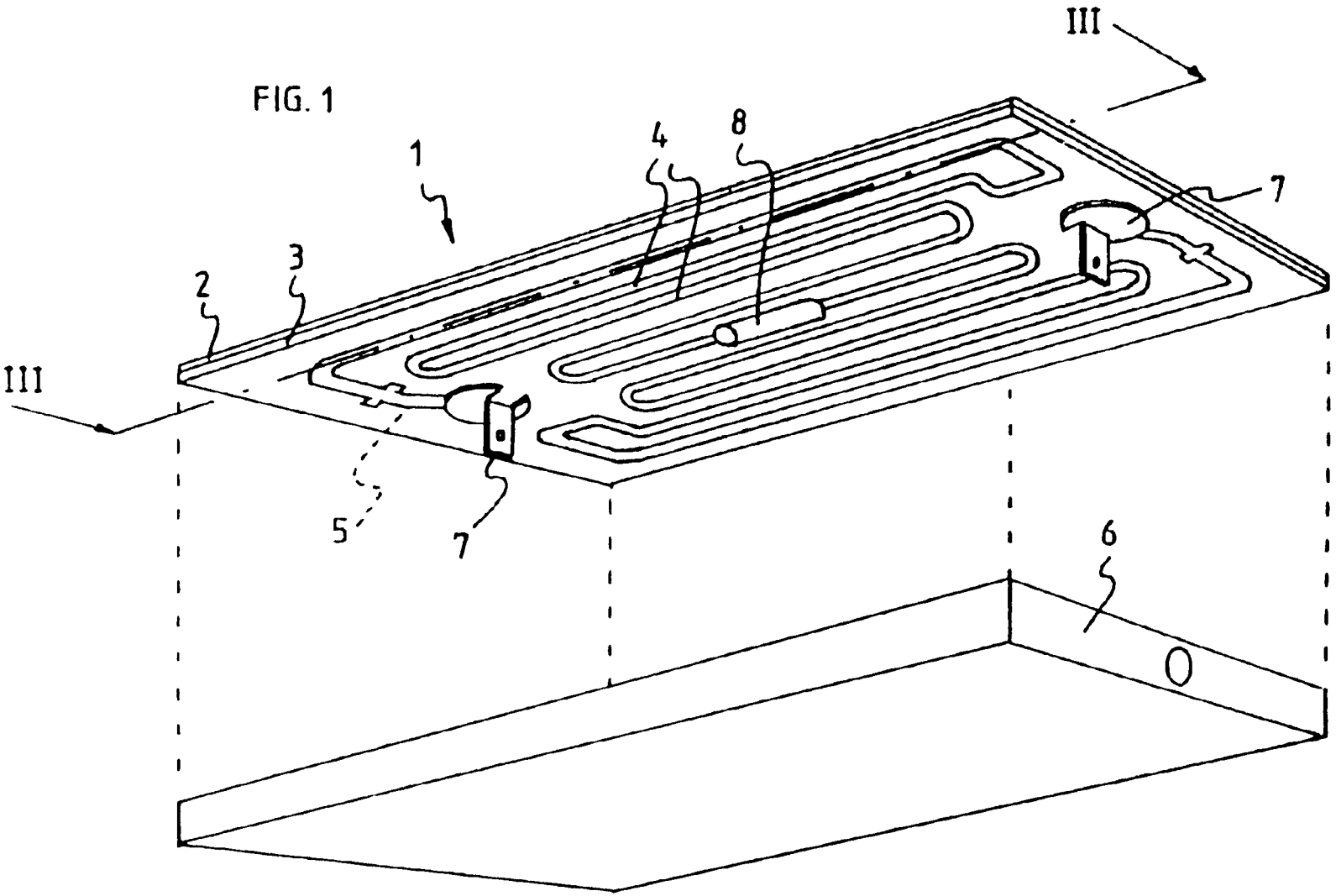

The object of the invention is to provide a heating element for a water-bed, which heating element can easily be arranged in a water-bed and the heat transfer of which from the heat source itself to the water-bed is optimal, and which heating element, together with control means, is able to control and maintain the temperature of the water-bed within very narrow limits.

The object of the invention is achieved by means of a heating element of the type described in the preamble by the fact that said electrical insulator for insulating the electrically resistive conductor from the metal plate is a layer of vitreous material with a very high electrical resistance is screen-printed on the metal support plate, and in that the electrically resistive conductor is screen-printed on this vitreous insulating layer.

These measures provide a compact heating element which is not fragile, is very well electrically insulated from the surroundings and is slightly resilient, so that there is no risk of the wiring of the heating element being interrupted from outside over the course of time by chemical or mechanical influences. An electrical heating element of this kind according to the invention is extremely inexpensive by comparison with the known heating elements, and because the heat only has to pass through a pair of very thin layers, and hence also only a small number of changes of material, the heat will be given off to the water-bed very quickly when the heating element is switched on and off, and consequently it will be possible to control the heat extremely quickly within narrow temperature limits. As a result, the power consumption will also be lower while nevertheless generating sufficient heat. The structure of a heating element according to the invention is also considerably more simple and easier to attach than with the heating elements known to date. Due to the fact that the intermediate layer comprises a very thin insulating layer which is easy to apply and adheres directly to the support plate, the heat transfer is very rapid and hence efficient.

In a preferred embodiment of a heating element according to the invention, the materials from which respectively the metal support plate, the thin intermediate layer, the conductors and the protective thin layer are made have essentially the same coefficient of thermal expansion.

Due to the fact that all the layers have approximately the same coefficient of expansion, the intermediate layer with the electrically resistive conductors can be arranged over the entire width of the support plate without there being any risk of stresses being produced between the various layers as the temperature changes, which could cause the layers to become detached from one another.

The invention will be explained in more detail with reference to the drawing, which shows an exemplary embodiment of the device according to the invention and in which:

FIG. 1: shows a perspective view of a heating element according to the invention;

FIG. 2: shows a cross-section through a water-bed with a heating element according to the invention;

FIG. 3: shows a cross-section through the heating element as illustrated in FIG. 1 on line III—III.

FIG. 1 shows the underside of a heating element 1 according to the invention. The heating element 1 comprises a support plate 2 made of, for example, stainless steel, on which a vitreous insulating layer 3 is arranged by means of a screen-printing process. This insulating layer 3 has good electrically insulating properties, while conducting heat well, and serves as an electrically insulating thin intermediate layer 3. An electrically resistive conductor 4 is arranged on top of the insulating layer 3. This electrically resistive conductor 4 consists of a metal and is applied to the insulating layer 3 by means of a screen-printing process. The underside of the plate is covered by an electrically insulating thin cover layer 5, with the result that the electrically resistive conductor 4 is electrically insulated on all sides from the surroundings (cf. FIG. 3). The electrical heating element is closed off on the underside by means of a plastic tray 6, and these two components are connected together in the region of the edges, so that the electrical connection points are insulated from the surroundings.

The electrically resistive conductor 4 comprises a virtually flat track which runs in the form of a zig-zag over the underside of the heating element 1, without in the process crossing itself. The two ends of the electrically resistive conductor 4 are each connected to electrical contact elements 7, which serve to attach the wiring which connects the electrically resistive conductor 4 to an electric power supply, which is not shown here. A thermal fuse 8 is connected in series with the heating element, interrupting the circuit if the heating element becomes too hot.

FIG. 2 shows a cross-section of a water-bed 9, comprising a base 10, on which a pit-like part or bed frame 11 is placed, with a pit-like recess 12, in which a water pocket or water core 13 is laid, comprising a flexible casing 14 filled with water 15. A protective sheet 16 is arranged between the water core 13 and the bed frame 11. A cover 17 is arranged around the whole of the bed frame 11 and the water core 13. A heating element 1 according to the invention is arranged between the bed frame 11 and the protective sheet 16, approximately in the centre. This heating element 1 can be connected to the electricity mains using a standard plug 18 and wiring 19. A control mechanism 20 can be used to set the heating element 1 to a desired temperature, after which the temperature of the water-bed will be controlled within a defined temperature range.

What is claimed is:

1. Heating element for heating a water-bed, said heating element comprising a metal support plate with a high coefficient of thermal conductivity, a heat source attached to the metal support plate, said heat source comprising an electrically resistive conductor which emits heat when electricity passes through it, and an electrical insulator for insulating the heat source from the metal plate, characterized in that, said electrical insulator for insulating the electrically resistive conductor from the metal plate is a layer of vitreous insulating material with a very high electrical resistance is screen-printed on the metal support plate, and in that the electrically resistive conductor is screen-printed on said vitreous insulating layer.

2. Heating element according to claim 1, characterized in that, the side of the electrically resistive conductor opposite the metal support plate is covered by an electrically protective thin cover layer which has a very high electrical resistance.

3. Heating element according to claim 2, characterized in that the materials from which respectively the metal support plate, the vitreous insulating layer, the conductor and the protective thin layer are made have essentially the same coefficient of thermal expansion.

4. Heating element according to one of the preceding claims, characterized in that the vitreous insulating layer has a thickness of between 0.4 and 1 mm.

* * * * *